US011008839B2

(12) United States Patent
Collier et al.

(10) Patent No.: US 11,008,839 B2
(45) Date of Patent: May 18, 2021

(54) SHAPED CHARGE SLITTING DEVICES FOR CONTROL LINE DISRUPTION IN A HYDROCARBON WELL AND RELATED METHODS FOR SEALING THE HYDROCARBON WELL

(71) Applicant: ExxonMobil Upstream Research Company, Spring, TX (US)

(72) Inventors: Nicholas Collier, Smithville, TX (US); Joseph W. Witt, The Woodlands, TX (US); Brandon M. Baumert, Aberdeen (GB)

(73) Assignee: ExxonMobil Upstream Research Company, Spring, TX (US)

( * ) Notice: Subject to any disclaimer, the term of this patent is extended or adjusted under 35 U.S.C. 154(b) by 47 days.

(21) Appl. No.: 16/596,824

(22) Filed: Oct. 9, 2019

(65) Prior Publication Data

US 2020/0141213 A1 May 7, 2020

Related U.S. Application Data

(60) Provisional application No. 62/754,359, filed on Nov. 1, 2018.

(51) Int. Cl.
*E21B 43/117* (2006.01)
*E21B 33/138* (2006.01)

(52) U.S. Cl.
CPC ..... *E21B 43/117* (2013.01); *E21B 33/138* (2013.01)

(58) Field of Classification Search
CPC ..... E21B 43/116; E21B 43/117; E21B 33/13; E21B 33/138; E21B 29/02
See application file for complete search history.

(56) References Cited

U.S. PATENT DOCUMENTS

| | | | | |
|---|---|---|---|---|
| 2,684,030 | A | 7/1954 | Muskat et al. | |
| 3,057,295 | A | 10/1962 | Christopher | |
| 4,676,309 | A | 6/1987 | Gonzalez | |
| 5,195,588 | A * | 3/1993 | Dave | E21B 49/10 166/264 |
| 6,016,753 | A | 1/2000 | Glenn et al. | |

(Continued)

FOREIGN PATENT DOCUMENTS

WO WO 2009/117548 A1 9/2009

*Primary Examiner* — David Carroll
(74) *Attorney, Agent, or Firm* — ExxonMobil Upstream Research Company—Law Department

(57) ABSTRACT

Shaped charge slitting devices for control line disruption in a hydrocarbon well and related methods for sealing the hydrocarbon well. The shaped charge slitting devices include a plurality of shaped charges. Each shaped charge is configured to, upon actuation, transform a corresponding liner into a high-speed sheet portion, which is configured to form a circumferential slit within production tubing, and a low-speed slug portion, which is configured to at least partially seal the circumferential slit. The methods include positioning a shaped charge slitting device within a selected region of a tubing conduit, actuating the shaped charge slitting device to form a plurality of circumferential slits within the production tubing and also to sever a control line, pumping a sealing material into an annular space via a sealing material injection opening that extends between the tubing conduit and the annular space, and curing the sealing material to form a fluid seal.

20 Claims, 10 Drawing Sheets

(56) References Cited

U.S. PATENT DOCUMENTS

| | | | | |
|---|---|---|---|---|
| 6,298,913 | B1 | 10/2001 | Box | |
| 6,505,559 | B1 | 1/2003 | Joslin et al. | |
| 6,792,866 | B2 | 9/2004 | Grattan | |
| 7,073,448 | B2 | 7/2006 | Bell | |
| 7,661,367 | B2 | 2/2010 | Yang et al. | |
| 8,561,683 | B2 | 10/2013 | Wood et al. | |
| 2013/0269948 | A1* | 10/2013 | Hoffman | E21B 33/13 166/351 |
| 2013/0299194 | A1 | 11/2013 | Bell et al. | |
| 2015/0129203 | A1* | 5/2015 | Deutch | E21B 43/11 166/250.1 |
| 2018/0252507 | A1 | 9/2018 | Collier | |

* cited by examiner

SHAPED CHARGE SLITTING DEVICES FOR CONTROL LINE DISRUPTION IN A HYDROCARBON WELL AND RELATED METHODS FOR SEALING THE HYDROCARBON WELL

CROSS-REFERENCE TO RELATED APPLICATION

This application claims the benefit of U.S. Provisional Application 62/754,359 filed Nov. 1, 2018 entitled "Shaped Charge Slitting Devices for Control Line Disruption in a Hydrocarbon Well and Related Methods for Sealing the Hydrocarbon Well," the entirety of which is incorporated by reference herein.

FIELD OF THE DISCLOSURE

The present disclosure relates generally to shaped charge slitting devices for control line disruption in a hydrocarbon well and/or to related methods for sealing the hydrocarbon well.

BACKGROUND OF THE DISCLOSURE

Hydrocarbon wells that extend within a subterranean formation periodically must be plugged, abandoned, and/or sealed, such as to restrict fluid flow therein. As an example, and subsequent to production of an economically viable fraction of hydrocarbons from a given subterranean formation, one or more hydrocarbon wells may be plugged and abandoned. The plugging and abandonment process generally includes formation of one or more fluid seals within wellbores of the hydrocarbon wells, and these fluid seals may be configured to resist fluid flow therepast.

Several conventional processes for plugging and abandonment of hydrocarbon wells exist. These conventional processes for plugging and abandonment may be effective in situations in which no control lines extend within wellbores of the hydrocarbon wells. For example, control lines often extend within a wellbore and exterior to a well's production tubing. When control lines are present, they represent a potential leak path through the fluid seals, and it may be undesirable to permit this potential leak path to remain after the wellbore is plugged and abandoned.

Thus, more involved plugging and abandonment procedures have been developed for hydrocarbon wells that include control lines. These more involved procedures generally include operations to remove both tubing and control lines, which extend within the wellbore, prior to forming the fluid seal within the wellbore. Additionally or alternatively, coiled tubing may be utilized to position the fluid seal within the wellbore. Both of these operations are time-consuming and costly. Thus, there exists a need for improved methods for improved shaped charge slitting devices for control line disruption in a hydrocarbon well and/or for related methods for sealing the hydrocarbon well.

SUMMARY OF THE DISCLOSURE

Shaped charge slitting devices for control line disruption in a hydrocarbon well and related methods for sealing the hydrocarbon well are disclosed herein. The shaped charge slitting devices include a device body and a plurality of shaped charges. Each shaped charge of the plurality of shaped charges is configured to, upon actuation of the shaped charge, transform a corresponding liner of the shaped charge into a corresponding high-speed sheet portion and a corresponding low-speed slug portion. The corresponding high-speed sheet portion is configured to form a corresponding circumferential slit within production tubing, while the corresponding low-speed slug portion is configured to at least partially seal the corresponding circumferential slit.

The methods include positioning a shaped charge slitting device within a selected region of a tubing conduit that is defined by production tubing within a wellbore of a hydrocarbon well. The hydrocarbon well also includes a casing string that extends within the wellbore and defines a casing conduit. The production tubing extends within the casing conduit, and the production tubing and casing string define an annular space therebetween. A control line extends within the annular space. The methods also include actuating the shaped charge slitting device. The actuating includes accelerating a corresponding liner of each shaped charge of the plurality of shaped charges and, responsive to the accelerating, forming a corresponding high-speed sheet portion and a corresponding low-speed slug portion from the corresponding liner of each activated shape charge. The actuating also includes defining a corresponding circumferential slit within the production tubing with the corresponding high-speed sheet portion and severing the control line with the corresponding high-speed sheet portion of at least one activated shaped charge of the plurality of shaped charges. The actuating further includes at least partially sealing the corresponding circumferential slit with the corresponding low-speed slug portion of the at least one activated shape charge. The methods further include pumping a sealing material into an annular space via a sealing material injection opening that extends between the tubing conduit and the annular space, and curing the sealing material to form a fluid seal.

DETAILED DESCRIPTION AND BEST MODE OF THE DISCLOSURE

Figure 1:
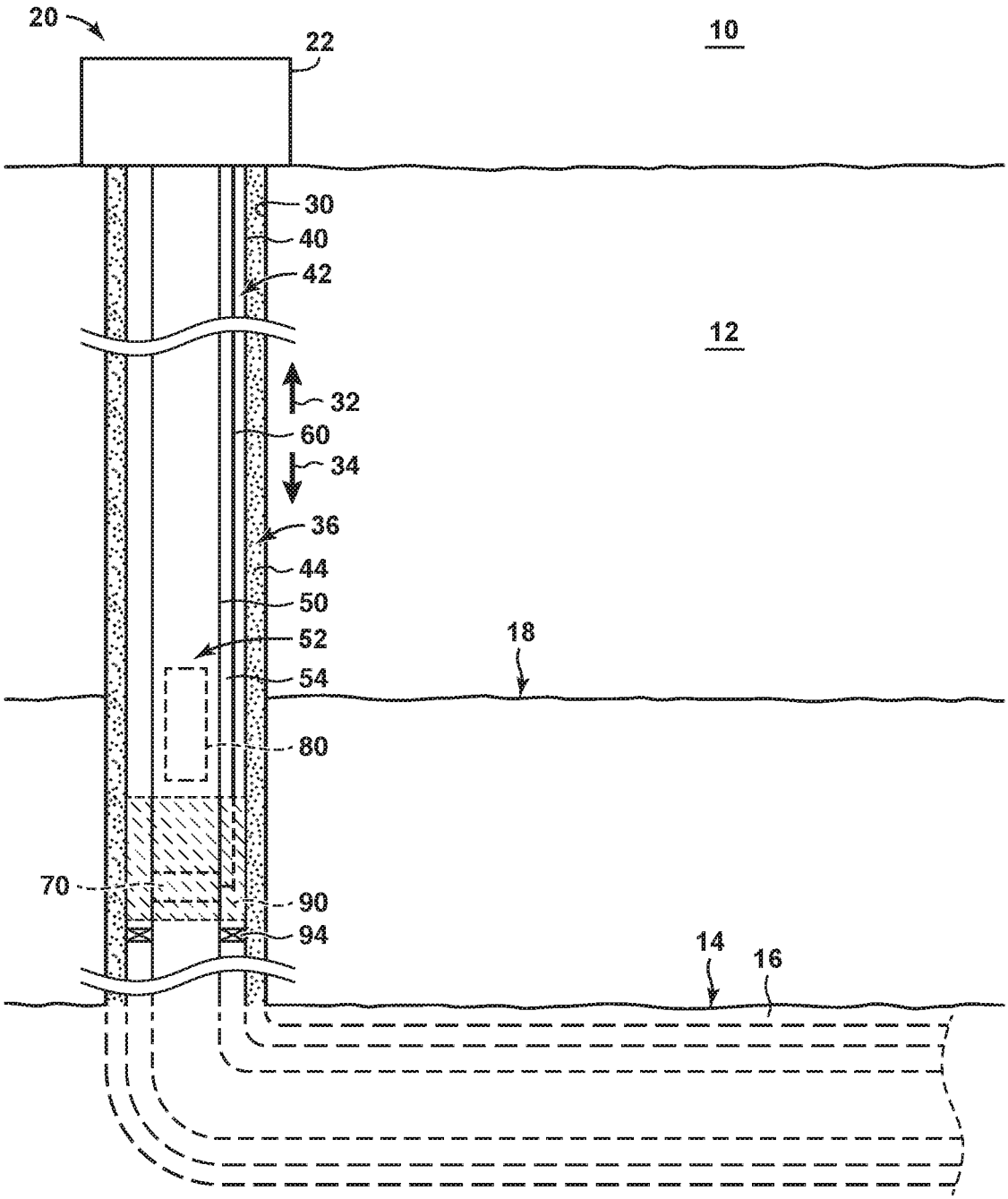
FIG. 1 is a schematic illustration of examples of a hydrocarbon well that may include and/or may be utilized with the shaped charge slitting devices and/or methods, according to the present disclosure.

FIGS. 1-18 provide examples of hydrocarbon wells 20 and/or of methods 300, according to the present disclosure. Elements that serve a similar, or at least substantially similar, purpose are labeled with like numbers in each of FIGS. 1-18, and these elements may not be discussed in detail herein with reference to each of FIGS. 1-18. Similarly, all elements may not be labeled in each of FIGS. 1-18, but reference numerals associated therewith may be utilized herein for consistency. Elements, components, and/or features that are discussed herein with reference to one or more of FIGS. 1-18 may be included in and/or utilized with any of FIGS. 1-18 without departing from the scope of the present disclosure.

In general, elements that are likely to be included in a particular embodiment are illustrated in solid lines, while elements that are optional are illustrated in dashed lines. However, elements that are shown in solid lines may not be essential to all embodiments and, in some embodiments, may be omitted without departing from the scope of the present disclosure.

FIG. 1 is a schematic illustration of examples of a hydrocarbon well 20 that may include and/or may be utilized with shaped charge slitting devices 80 and/or methods 300, according to the present disclosure. Hydrocarbon well 20 includes a wellhead 22 and a wellbore 30. Wellbore 30 extends within a subterranean formation 14 and also may be referred to herein as extending within a subsurface region 12 and/or as extending between a surface region 10 and subterranean formation 14. Subterranean formation 14 includes hydrocarbons 16, and a cap rock 18 may separate the subterranean formation from the surface region. Wellbore 30 defines an uphole direction 32 and a downhole direction 34. Uphole direction 32 extends generally along the length of the wellbore and toward surface region 10, while downhole direction 34 extends generally along the length of the wellbore and away from the surface region.

Hydrocarbon well 20 includes a casing string 40, which extends within wellbore 30 and defines a casing conduit 42. A casing seal 44, such as cement, extends between wellbore 30 and casing string 40. Additionally or alternatively, the casing seal at least partially and/or fluidly seals an annular space 36 that extends between the wellbore and the casing string.

The hydrocarbon well also includes production tubing 50, which extends within casing conduit 42 and defines a tubing conduit 52. Casing string 40 and production tubing 50 define an annular space 54 therebetween. One or more production packers, or packers, 94 may extend within annular space 54 and/or may restrict fluid communication between a region of the annular space that is downhole from the production packer and a region of the annular space that is uphole from the production packer.

At least one control line 60 extends within annular space 54. Control line 60 may include any suitable electrical, hydraulic, and/or pneumatic control line that may be adapted, configured, designed, and/or constructed to convey one or more power and/or control signals along the length of wellbore 30 and/or between surface region 10 and subsurface region 12. As an example, a downhole device 70 may be positioned within wellbore 30 and may be in electrical, hydraulic, pneumatic, and/or mechanical communication with control line 60. Stated another way, control line 60 may be configured to control the operation of downhole device 70, to provide power to downhole device 70, to receive a signal from downhole device 70, to provide one or more materials, or fluids, to downhole device 70, and/or to receive one or more materials, or fluids, from downhole device 70. Examples of downhole device 70 include any suitable downhole sensor, downhole temperature sensor, downhole pressure sensor, downhole chemical injection structure, downhole electrical device, downhole pneumatic device, and/or downhole hydraulic device.

In practice, control line 60 may be anchored, tied, affixed, and/or otherwise coupled to an external surface of production tubing 50 and/or to an internal surface of casing string 40. As an example, the control line may be operatively attached to the production tubing at, or near, casing collars of the production tubing. However, these particular configurations are not required of all embodiments.

As discussed, it may be desirable to form a fluid seal, or a plug, 90 within hydrocarbon well 20 and/or within wellbore 30 thereof. Fluid seal 90 may permit and/or facilitate abandonment of the hydrocarbon well, such as by resisting, blocking, and/or occluding fluid flow between a region of the wellbore that is uphole of the plug and a region of the wellbore that is downhole of the plug. As illustrated, fluid seal 90 may extend both within annular space 54 and within tubing conduit 52, thereby restricting fluid flow therepast both within the annular space and within the tubing conduit.

As also discussed, control line 60 may represent a potential leak pathway through fluid seal 90. As an example, control line 60 may include an insulated wire, and degradation of the insulation and/or of the wire may cause a leak path through fluid seal 90. As another example, control line 60 may include a stranded wire than inherently may include the leak path. As yet another example, control line 60 may include a fluid conduit, such as a hydraulic and/or a pneumatic fluid conduit, that inherently may include the leak path.

As discussed in more detail herein, a shaped charge slitting device 80 may be utilized to cut and/or sever control line 60, thereby permitting and/or facilitating formation of fluid seal 90 and/or plugging and/or abandonment of hydrocarbon well 20. Examples of shaped charge slitting devices 80, according to the present disclosure, are illustrated in FIGS. 2-6 and indicated at 80. Shaped charge slitting devices 80 may be configured to form a plurality of circumferential slits within production tubing, such as production tubing 50 of FIG. 1, while the production tubing extends within a wellbore that extends within a subterranean formation. Shaped charge slitting devices 80 also may be configured to seal the plurality of circumferential slits. Shaped charge slitting devices 80 further may be configured to sever a control line, such as control line 60 of FIG. 1, that extends within an annular space defined between the wellbore and the production tubing. Formation of the circumferential slits, sealing of the circumferential slits, and/or severing of the control line utilizing shaped charge slitting device 80, according to the present disclosure, is discussed in more detail herein with reference to methods 300 of FIG. 7.

As illustrated collectively by FIGS. 2-6, shaped charge slitting devices 80 include a device body 200 that defines a body longitudinal axis 202. Device body 200 also may be referred to herein as, and/or may be, a cylindrical device body 200. Shaped charge slitting devices 80 also include a plurality of shaped charges 220 that may be spaced-apart along and rotationally offset within the body longitudinal axis. Each shaped charge 220 may be positioned within a corresponding shaped charge recess 210, which may be at least partially defined by and/or within device body 200.

Each shaped charge 220 includes a corresponding explosive charge 230 and a corresponding liner 240. A given shaped charges 220 may be actuated, such as via explosion of the corresponding explosive charge 230. Actuation of the given shaped charge may produce and/or generate deformation the corresponding liner and may accelerate the corresponding liner away from device body 200, as discussed in more detail herein.

The corresponding explosive charge may extend at least partially between the device body and the corresponding liner and may define a corresponding liner recess 232. The corresponding liner may extend at least partially within the corresponding liner recess such that the corresponding explosive charge extends at least partially between the device body and the corresponding liner. The corresponding liner may include a plurality of fluted regions 243 that may undulate circumferentially around and/or about a circumference of the device body.

Each shaped charge 220 extends circumferentially around a threshold fraction of the circumference of the device body. This is illustrated in FIGS. 2-5 and perhaps most clearly in FIGS. 3-4. Examples of the threshold fraction include threshold fractions of at least 10%, at least 20%, at least 30%, at least 40%, and/or at least 50%. Additional examples of the threshold fraction include threshold fractions of at most 90% at most 80%, at most 70%, at most 60%, at most 50%, and/or at most 40%. Stated another way, and as illustrated, an individual shaped charge 220 may not extend around an entirety of the circumference of the device body, such as to permit formation of circumferential slits within the production tubing via actuation of the individual shaped charge 220 and also to preclude complete severing of the production tubing via actuation of the individual shaped charge.

Figure 2:
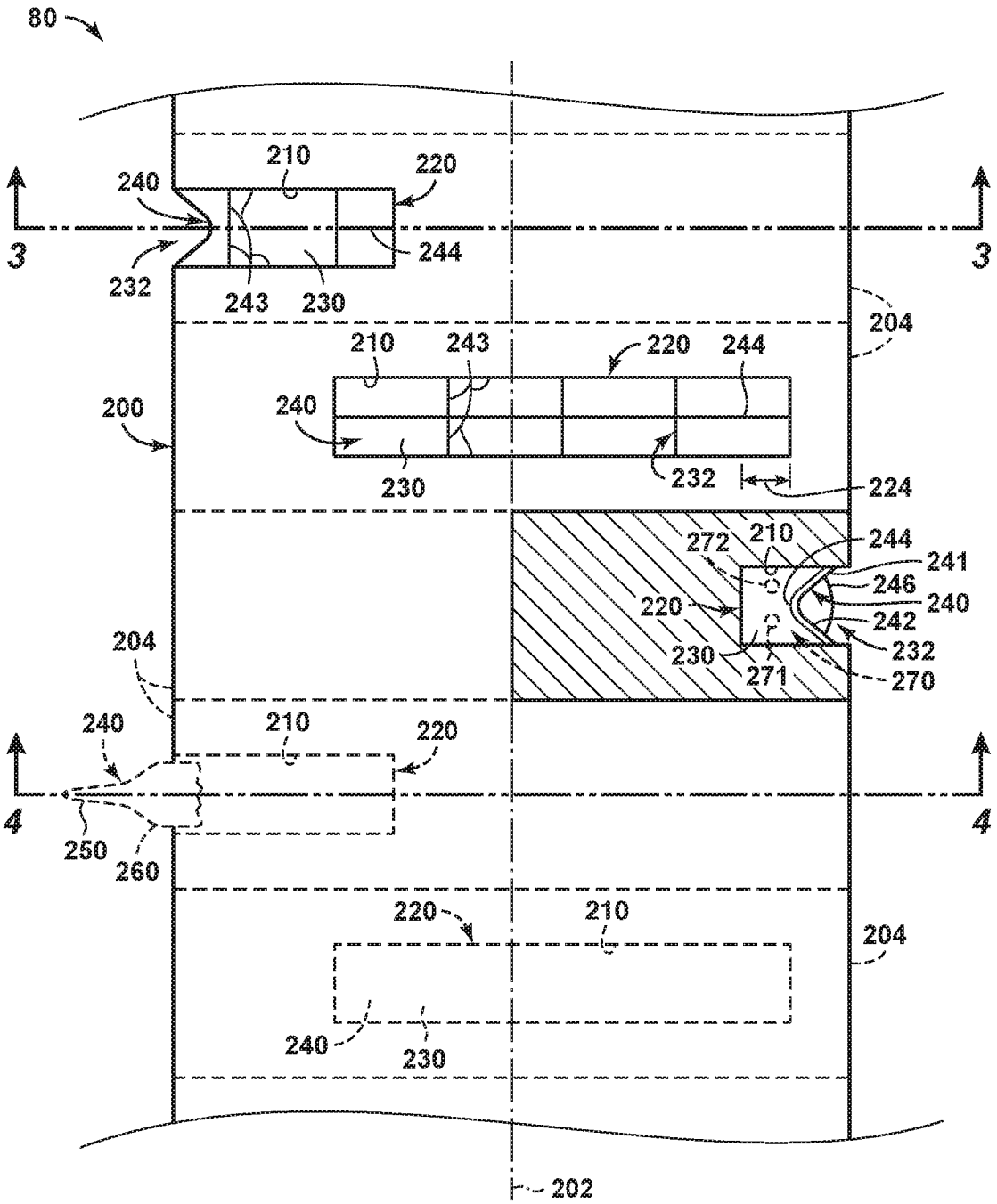
FIG. 2 is a schematic side view illustrating examples of a shaped charge slitting device according to the present disclosure.
Figure 5:
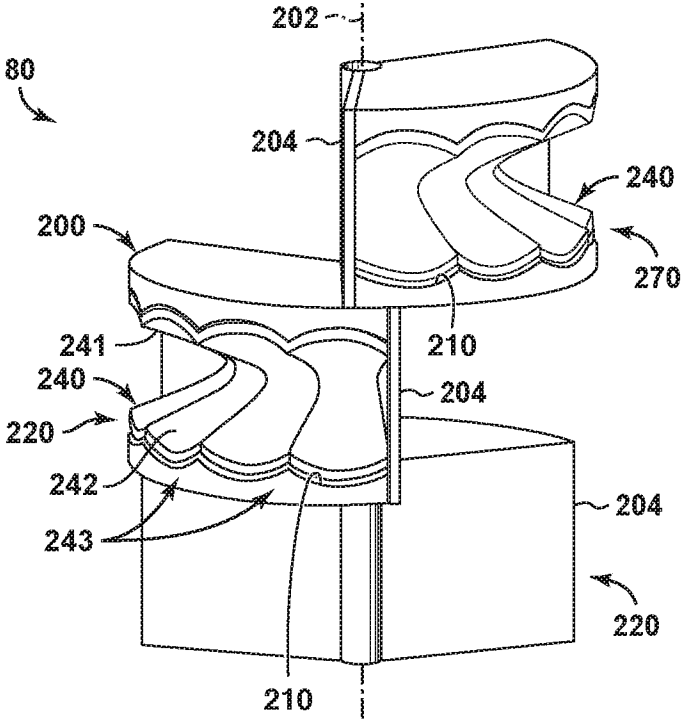
FIG. 5 is a less schematic illustration of an example of a shaped charge slitting device according to the present disclosure.

In addition, each shaped charge 220 at least partially circumferentially overlaps with at least two other shaped charges. This at least partial circumferential overlap is illustrated in FIGS. 2 and 5 and indicated at 224 in FIG. 2. The plurality of shaped charges also is angularly phased around the circumference of the device body such that the plurality of shaped charges collectively extends around an entirety of the circumference of the device body. Such a configuration may permit the plurality of shaped charges 220 to sever a control line that is at any given location around the production tubing. Stated another way, the plurality of shaped charges may be configured such that, the plurality of shaped charges collectively severs about an entirety of the circumference of the production tubing without physically severing the production tubing due to the longitudinal spacing of the shape charges along the body of the shape charge slitting device.

Figure 4:
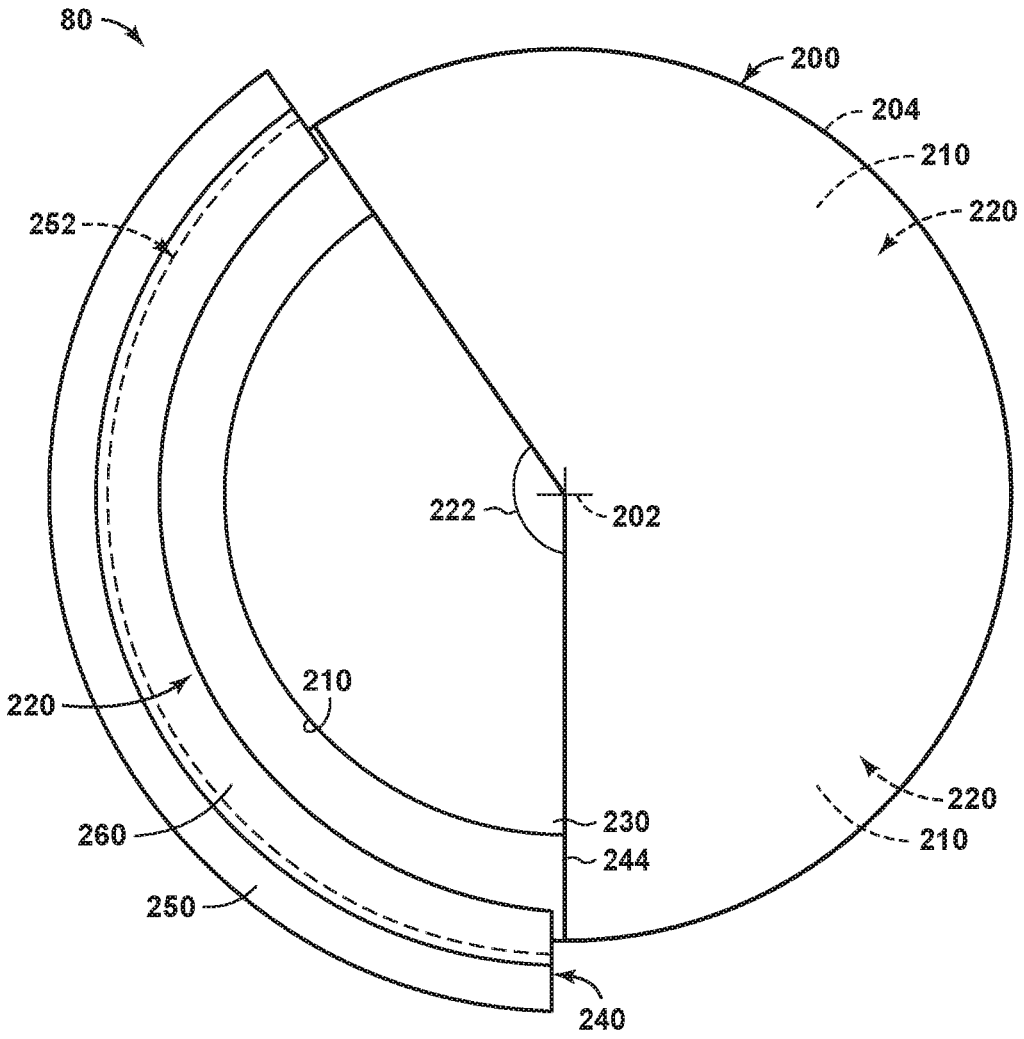
FIG. 4 is a schematic cross-sectional view of the shaped charge slitting device of FIG. 2 taken along line 4-4 of FIG. 2.
Figure 6:
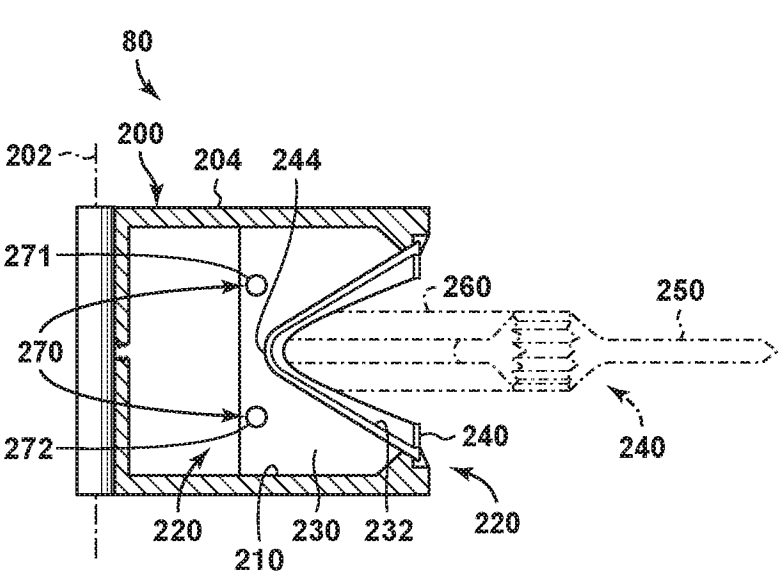
FIG. 6 is another less schematic illustration of an example of a shaped charge slitting device according to the present disclosure.

Furthermore, each shaped charge 220 is configured to, upon actuation, transform the corresponding liner 240 into a corresponding high-speed sheet portion 250 and a corresponding low-speed slug portion 260, as illustrated in dashed lines in FIG. 2 and in solid lines in FIGS. 4 and 6. Stated another way, each shaped charge, or the corresponding liner thereof, may be configured to, upon actuation, spatially separate into the corresponding high-speed sheet portion and the corresponding low-speed slug portion. This spatial separation may be caused by the difference in speed between the corresponding high-speed sheet portion and the corresponding low-speed slug portion.

Each corresponding high-speed sheet portion 250 may travel relatively faster when compared to the corresponding low-speed slug portion 260 and may be configured to form a corresponding circumferential slit within the production tubing and to sever any control line that is external to, or within, the slit portion of the production tubing. Each corresponding low-speed slug portion may travel relatively slower when compared to the corresponding high-speed sheet portion and may be configured to at least partially, or even completely, seal the corresponding circumferential slit.

It is within the scope of the present disclosure that, upon actuation of a given shaped charge, the corresponding high-speed sheet portion may have and/or define any suitable sheet speed, or average sheet speed. As examples, the sheet speed may be at least 2 kilometers per second (km/s), at least 3 km/s, at least 4 km/s, at least 5 km/s, or at least 6 km/s. Additionally or alternatively, the sheet speed may be at most 10 km/s, at most 9 km/s, at most 8 km/s, at most 7 km/s, at most 6 km/s, at most 5 km/s, or at most 4 km/s.

It is also within the scope of the present disclosure that a tip speed of the corresponding high-speed sheet portion may differ from a base speed of the corresponding high-speed sheet portion. The tip speed may be defined as a maximum speed of a leading edge of the high-speed sheet portion, while the base speed may be defined as a minimum speed of the high-speed sheet portion and/or as a speed of a trailing edge of the high-speed sheet portion. Examples of tip speed include tip speeds of at least 5 km/s, at least 6 km/s, at least 7 km/s, at least 8 km/s, at most 10 km/s, at most 9 km/s, and/or at most 8 km/s. Examples of the base speed include base speeds of at least 1 km/s, at least 2 km/s, at most 4 km/s, at most 3 km/s, and/or at most 2 km/s.

Similar to the corresponding high-speed sheet, the corresponding low-speed slug portion may have and/or define any suitable slug speed. As examples, the slug speed may be at most 0.25 km/s, at most 0.5 km/s, at most 0.75 km/s, at most 1.0 km/s, at most 1.25 km/s, or at most 1.5 km/s.

It is also within the scope of the present disclosure that, prior to contact with and/or penetration of the production tubing, high-speed sheet portion 250 and low-speed slug portion 260 may be defined by a single and/or by a continuous mass of liner 240 that deforms and travels from device body 200 upon actuation of shaped charges 220. Such a configuration is illustrated in dashed lines in FIG. 2. Alternatively, it is also within the scope of the present disclosure that a separation region 252 may spatially separate high-speed sheet portion 250 from low-speed slug portion 260, as illustrated in FIG. 4.

It is within the scope of the present disclosure that the corresponding high-speed sheet portion 250 may be configured to form the corresponding circumferential slit within the production tubing without forming a corresponding perforation and/or slit in and/or within a casing string, such as casing string 40 of FIG. 1, that extends within the wellbore and external to the production tubing. Stated another way, each shaped charge 220 may be designed and/or configured such that an energy and/or a momentum of the corresponding high-speed sheet portion is sufficient to penetrate the production tubing and/or to form the corresponding circumferential slit within the production tubing. However, the energy and/or the momentum of the corresponding high-speed sheet portion is insufficient, subsequent to penetrate the casing string subsequent to passing through the production tubing. Such a configuration may permit and/or facilitate formation of the plurality of circumferential slits within the production tubing without formation of a corresponding plurality of perforations and/or circumferential slits within the casing string, which may maintain fluid-impermeability of the casing string.

Figure 3:
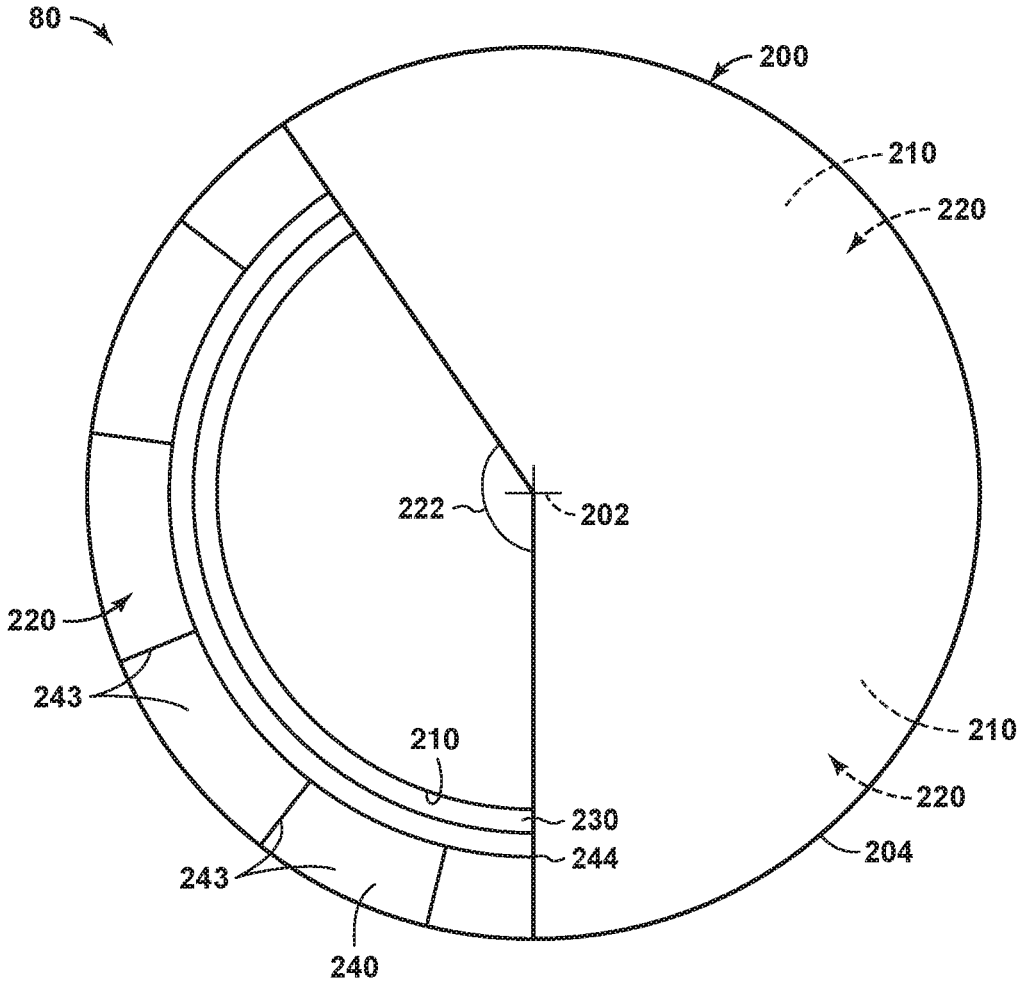
FIG. 3 is a schematic cross-sectional view of the shaped charge slitting device of FIG. 2 taken along line 3-3 of FIG. 2.

Shaped charges 220 may have and/or define any suitable shape and/or geometry. As an example, and as perhaps best illustrated in FIGS. 3-5, shaped charges 220 may be arcuate about the circumference of device body 200. Stated another way, and as illustrated in FIGS. 3-4, shaped charges 220 may define an arc angle 222 about the circumference of device body 200. Arc angle 222 may be defined by, or may bound, the circumferential extent, or a circumferential length, of shaped charges 220. Examples of arc angle 222 include angles of at 30 degrees, at least 45 degrees, at least 60 degrees, at least 75 degrees, at least 90 degrees, at least 105 degrees, at least 120 degrees, at least 135 degrees, at least 150 degrees, at least 165 degrees, and/or at least 180 degrees. Additional examples of arc angle 222 include angles of at most 330 degrees, at most 315 degrees, at most 300 degrees, at most 285 degrees, at most 270 degrees, at most 255 degrees, at most 240 degrees, at most 225 degrees, at most 210 degrees, at most 195 degrees, at most 180 degrees, at most 165 degrees, at most 150 degrees, at most 135 degrees, at most 120 degrees, at most 105 degrees, and/or at most 90 degrees. As discussed herein, the circumferential extent of each shaped charge 220 may be less than 100%, thereby preventing the shape charge, when actuated, from severing the production tubing, as opposed to cutting a slit that extends only partially around the circumference of the production tubing. As such, the arc angle of each shaped charge 220 may be less than 360 degrees.

It is within the scope of the present disclosure that a longitudinal extent of each shaped charge 220, as measured along body longitudinal axis 202, may be less than a threshold fraction of the circumferential extent of the shaped charge. Examples of the threshold fraction include threshold fractions of less than 50%, less than 40%, less than 30%, less than 25%, less than 20%, less than 15%, and/or less than 10%.

As perhaps best illustrated in FIGS. 2 and 6, a longitudinal cross-section of liners 240, as taken along a central axis of device body 200, may define an at least partially triangular shape. Stated another way, liners 240 may taper outward from an apex 244 and/or toward an external surface of the device body. Stated yet another way, liners 240 may include a first liner surface 241 and a second liner surface 242. First liner surface 241 and second liner surface 242 both may extend from apex 244 and, as illustrated in FIG. 2, may define an included angle 246 therebetween. Examples of the included angle include angles of at least 40 degrees, at least 45 degrees, at least 50 degrees, at least 55 degrees, at least 60 degrees, at least 65 degrees, and/or at least 70 degrees. Additional examples of the included angle include angles of at most 80 degrees, at most 75 degrees, at most 70 degrees, at most 65 degrees, and/or at most 60 degrees. Such included angles may permit and/or facilitate Munroe jetting of liners 240 upon actuation of shaped charges 220.

As perhaps best illustrated in FIG. 5, liners 240 may include a plurality of at least partially conic regions. The partially conic regions may define the plurality of fluted regions 243 of the liners.

As illustrated in dashed lines in FIG. 2 and in solid lines in FIG. 6, each shaped charge 220 further may include an initiating device 270. Initiating device 270 may be configured to initiate actuation of the shaped charge and/or of explosive charge 230 of the shaped charge. An example of initiating device 270 includes a primer cord. It is within the scope of the present disclosure that each shaped charge 220 may include any suitable number of initiating devices 270. In one example, each shaped charge 220 includes a first initiating device 271 and a second initiating device 272, which may be symmetrically opposed to one another within the corresponding shaped charge and/or may be on opposed sides of apex 244. Such a configuration may permit and/or facilitate more complete and/or instantaneous explosion of explosive charge 230, thereby providing increased and/or more uniform acceleration of liner 240. Additionally or alternatively, the combination of the first initiating device and the second initiating device may cause first liner surface 241 and second liner surface 242 to accelerate toward one another faster, or to a greater extent, when compared to shaped charges that utilize a single initiating device. As such, two initiating devices may provide more energy for high-speed sheet portion 250 when compared to a single initiating device.

Liner 240 may include any suitable structure and/or material that may, upon actuation of shaped charge devices 220, form and/or define high-speed sheet portion 250 and low-speed slug portion 260. Examples of liner 240 include a metallic liner, a copper liner, a ceramic liner, a layered liner, a plural-layer liner, and/or a plural-material liner. Plural-layers and plural-material liners may be formed from two or more of these examples of suitable liner materials. A material, density, thickness, overall volume, and/or overall mass of liner 240 may be selected based upon a desired amount of penetration for high-speed sheet portion 250. For example, liner 240 may include a metal-ceramic liner. In this configuration, the metal may be relatively more dense, may accelerate more slowly, and/or may form and/or define a major fraction of the low-speed slug portion. In contrast, the ceramic may be relatively less dense, may accelerate relatively more quickly, and/or may form and/or define a major fraction of the high-speed slug portion.

Explosive charge 230 may include any suitable material and/or materials that may be selectively actuated, selectively ignited, and/or selectively exploded upon actuation of shaped charge 220. As examples, explosive charge 230 may include and/or be a cyclotrimethylenetrinitramine explosive charge, a nitroamine explosive charge, and/or a hexanitrostilbene explosive charge. A composition, volume, mass, and/or amount of explosive charge 230 may be selected based upon a desired amount of penetration for high-speed sheet portion 250, a desired velocity for high-speed sheet portion 250, and/or a desired velocity for low-speed slug portion 260. A relationship between an amount of explosive charge 230 that is utilized in a given shaped charge 220, a mass of liner 240 in the given shaped charge, and the speed of high-speed sheet portion 250 and/or low-speed slug portion 260 may be described by the Gurney equations.

Device body 200 may have and/or define any suitable structure and/or shape. As an example, device body 200 may include and/or be a metallic device body 200. As another example, and as discussed herein, device body 200 may define shaped charge recesses 210. Stated another way, shaped charges 220 may be at least partially inset within device body 200.

It is within the scope of the present disclosure that device body 200 may include and/or be a unitary, or a monolithic, device body 200. Additionally or alternatively, it is also within the scope of the present disclosure that device body 200 may be a modular device body formed from a plurality of device sub-bodies 204. Such a configuration may permit and/or facilitate assembly of a combination of the plurality of device sub-bodies 204 to produce and/or generate a shaped charge slitting device 80 that includes a target, or a desired, number of shaped charges 220. In such a configuration, and as discussed, device sub-bodies 204 may be circumferentially phased around the circumference of the device body.

It is also within the scope of the present disclosure that device body 200 may have and/or define any suitable outside diameter, or effective outside diameter, that may permit and/or facilitate insertion of shaped charge slitting devices 80 into a tubing conduit of a hydrocarbon well. Examples of the outside diameter include diameters of at least 4 centimeters, at least 6 centimeters, at least 8 centimeters, at least 10 centimeters, at least 12 centimeters, at least 14 centimeters, and/or at least 16 centimeters. Additional examples of the outside diameter include diameters of at most 20 centimeters, at most 18 centimeters, at most 16 centimeters, at most 14 centimeters, at most 12 centimeters, and/or at most 10 centimeters.

Additional examples of suitable shaped charges 220 are disclosed in U.S. patent application Ser. No. 15/910,885, the disclosure of which is hereby incorporated by reference.

Figure 7:
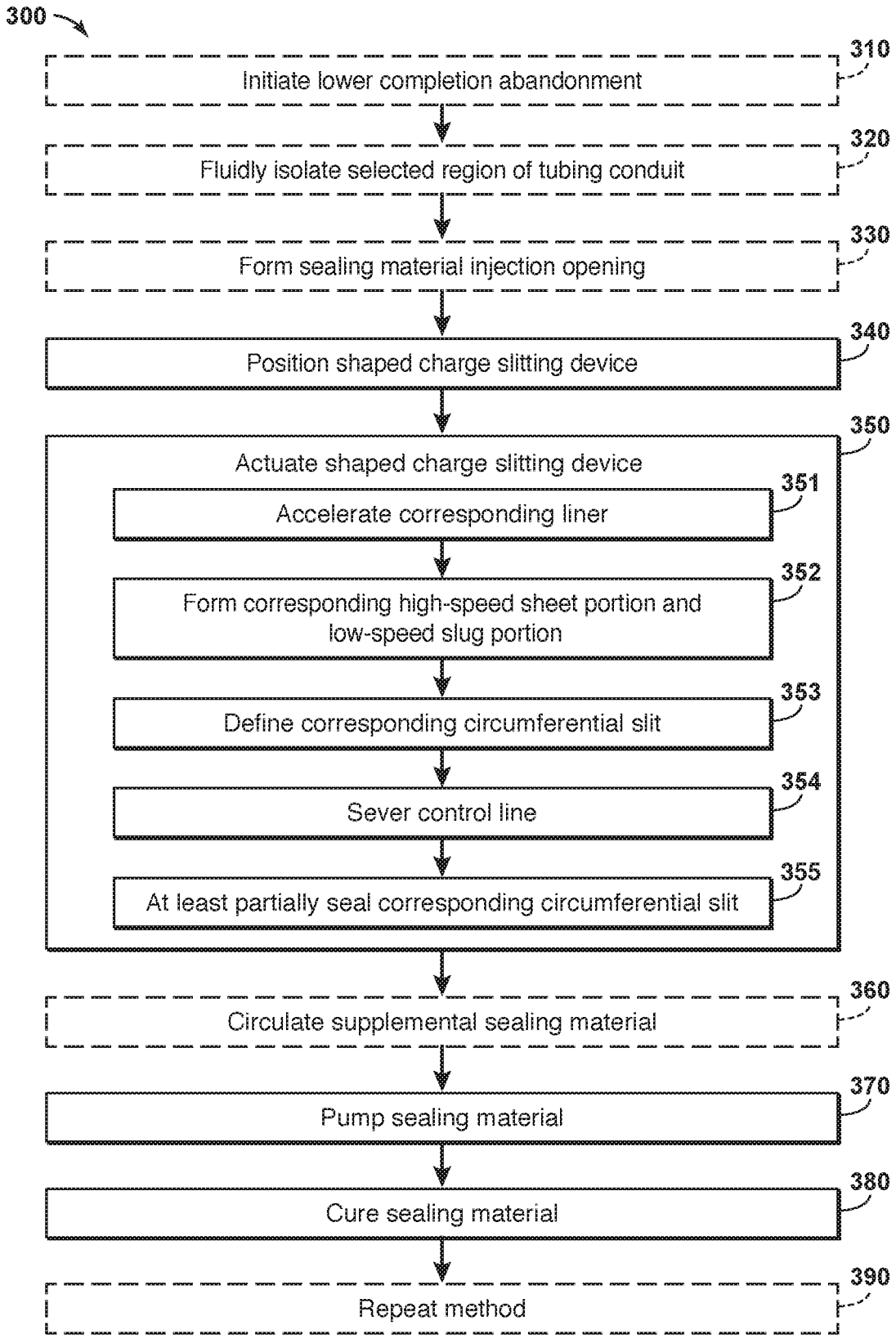
FIG. 7 is a flowchart depicting methods, according to the present disclosure, of sealing a hydrocarbon well.

FIG. 7 is a flowchart depicting examples of methods 300, according to the present disclosure, of sealing a hydrocarbon well. FIGS. 8-18 illustrate examples of portions of the methods of FIG. 7. The various components illustrated in FIGS. 8-18 are illustrated in FIG. 1 and discussed herein with reference thereto. FIGS. 7-18 generally illustrate a hydrocarbon well 20. More specifically, FIGS. 7-18 illustrate a portion of a wellbore 30 that extends within a subsurface region 12. A casing string 40 extends within the wellbore and defines a casing conduit 42. A casing seal 44, such as cement, extends within an annular space 36 that is defined between the casing string and the wellbore and/or seals the casing string to the wellbore, and production tubing 50 extends within the casing conduit and defines a tubing conduit 52. An annular space 54 is defined between the production tubing and the casing string, and a control line 60 extends within the annular space. As illustrated in FIGS. 8-10 and 15-18, the control line may be in communication with a downhole device 70, examples of which are discussed herein. Wellbore 30 defines an uphole direction 32 and a downhole direction 34.

Methods 300 may include initiating lower completion abandonment at 310, fluidly isolating a selected region of a tubing conduit at 320, and/or forming a sealing material injection opening at 330. Methods 300 include positioning a shaped charge slitting device at 340 and actuating the shaped charge slitting device at 350. Methods 300 may include circulating a supplemental sealing material at 360 and include pumping a sealing material at 370 and curing the sealing material at 380. Methods 300 further may include repeating at least a portion of the methods at 390.

While not required, the initiating lower completion abandonment at 310 may include initiating abandonment of any suitable lower completion of the hydrocarbon well in any suitable, or conventional, manner. As an example, the initiating at 310 may include at least partially sealing a region of the wellbore that is downhole from the downhole device. This may include squeezing cement into the region of the wellbore that is downhole from the downhole device and/or setting a mechanical plug in the region of the wellbore that is downhole from the downhole device.

Fluidly isolating the selected region of the tubing conduit at 320 may include fluidly isolating the selected region of the tubing conduit from a region of the tubing conduit that is downhole from the selected region of the tubing conduit. The fluidly isolating at 320 may be accomplished in any suitable manner. As an example, the fluidly isolating at 320 may include positioning an isolation device within the tubing conduit and/or downhole from the selected region of the tubing conduit. As another example, the fluidly isolating at 320 may include setting a plug within the tubing conduit and/or downhole from the selected region of the tubing conduit.

The fluidly isolating at 320 may be performed with any suitable timing and/or sequence during methods 300. As examples, the fluidly isolating at 320 may be performed subsequent to the abandoning at 310, prior to the forming at 330, prior to the positioning at 340, and/or at least partially concurrently with the positioning at 340.

Figure 8:
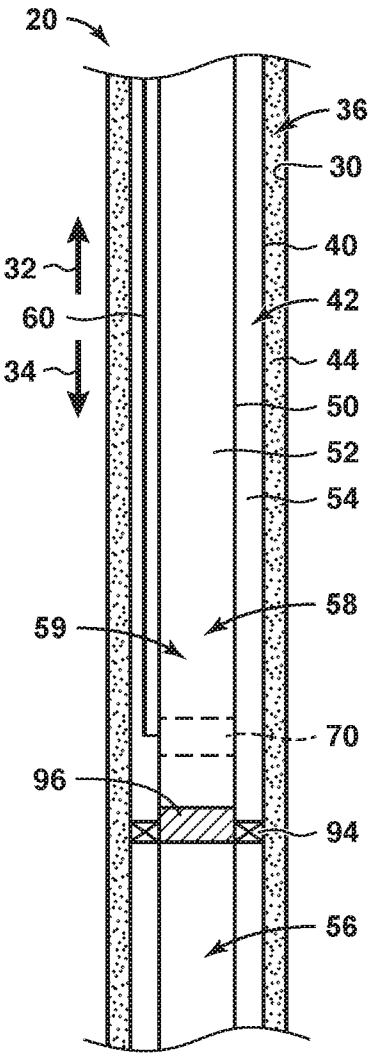
FIG. 8 is a schematic cross-sectional view of a region of a hydrocarbon well illustrating an example of a portion of the methods of FIG. 7.

An example of the fluidly isolating at 320 is illustrated in FIG. 8. As illustrated therein, the fluidly isolating at 320 may include positioning, or setting, an isolation device 96 within tubing conduit 52 and downhole from selected region 59 of the tubing conduit. Subsequent to the fluidly isolating at 320, an uphole region 58 of the tubing conduit may be fluidly isolated from a downhole region 56 of the tubing conduit by isolation device 96. As illustrated in FIG. 8, a packer 94 may, or already may, be positioned within annular space 54, thereby restricting fluid flow within the annular space.

Forming the sealing material injection opening at 330 may include forming, defining, and/or establishing any suitable sealing material injection opening within the production tubing. The sealing material injection opening may be utilized, during the pumping at 370, to facilitate flow of the sealing material into the annular space and/or sealing of the annular space.

The forming at 330 may be accomplished in any suitable manner. As an example, the forming at 330 may include perforating the production tubing, such as with, via, and/or utilizing a perforation device and/or a shaped charge perforation device. As another example, the forming at 330 may include opening a pre-existing valve, burst disk, and/or sliding sleeve that already was present within the production tubing.

The forming at 330 may include forming the sealing material injection opening downhole from the selected region of the tubing conduit. Alternatively, the forming at 330 may include forming the sealing material injection opening within a downhole portion of the selected region of the tubing conduit.

The forming at 330 may be performed with any suitable timing and/or sequence during methods 300. As examples, the forming at 330 may include forming the sealing material injection opening subsequent to the abandoning at 310, subsequent to the fluidly isolating at 320, prior to the positioning at 340, and/or at least partially concurrently with the positioning at 340.

Figure 9:
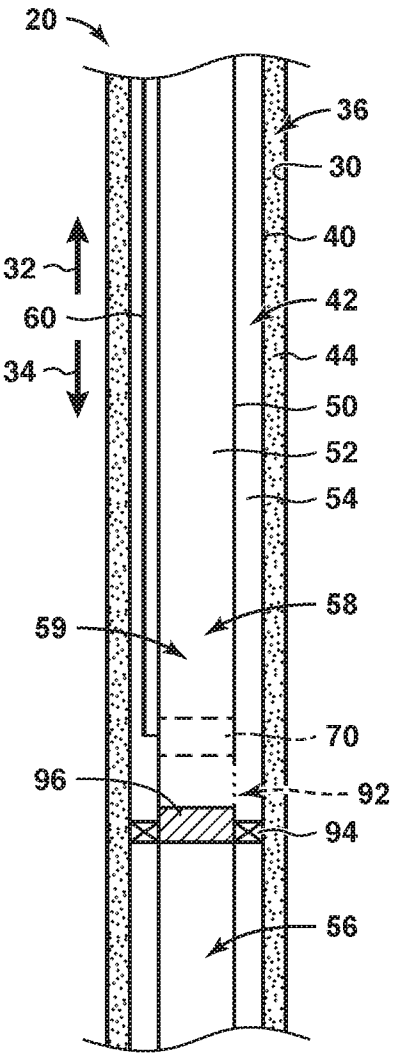
FIG. 9 is a schematic cross-sectional view of a region of a hydrocarbon well illustrating an example of a portion of the methods of FIG. 7.

An example of the forming at 330 is illustrated in FIG. 9. As illustrated there, and subsequent to the forming at 330, a sealing material injection opening 92 may be defined within production tubing 50. The sealing material injection opening may permit and/or facilitate fluid communication between uphole region 58 of tubing conduit 52 and annular space 54.

Positioning the shaped charge slitting device at 340 may include positioning the shaped charge slitting device within the selected region of the tubing conduit. The positioning at 340 may be accomplished in any suitable manner. As an example, the positioning at 340 may include conveying the shaped charge slitting device from a surface region and/or to the selected region of the tubing conduit. This may include conveying the shaped charge slitting device in any suitable manner, such as free-fall dropping the shaped charge slitting device, providing fluid to the tubing conduit and flowing the shaped charge slitting device into the tubing conduit within the fluid, conveying the shaped charge slitting device on a wireline, conveying the shaped charge slitting device on a slickline, conveying the shaped charge slitting device with a tractor, conveying the shaped charge slitting device with a wireline-attached tractor, and/or conveying the shaped charge slitting device with coiled tubing.

It is within the scope of the present disclosure that methods 300, or the positioning at 340, further may include detecting a location of the shaped charge slitting device within the tubing conduit. Under these conditions, the positioning at 340 may be based, at least in part, on the detecting. As an example, the positioning at 340 may include retaining the shaped charge slitting device within the selected region of the tubing conduit responsive to detecting that the shaped charge slitting device is within the selected region of the tubing conduit. The location of the shaped charge, within the tubing conduit, may be detected in any suitable manner. As examples, a position sensor and/or a casing collar locator may be utilized to detect the position of the shaped charge slitting device.

Figure 10:
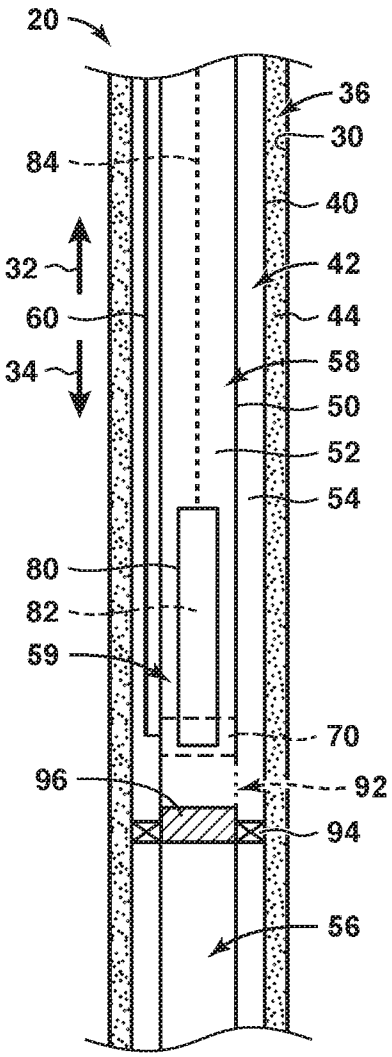
FIG. 10 is a schematic cross-sectional view of a region of a hydrocarbon well illustrating an example of a portion of the methods of FIG. 7.

An example of the positioning at 340 is illustrated in FIG. 10. As illustrated therein, and subsequent to the positioning at 340, a shaped charge slitting device 80, which may include a position sensor 82, may be positioned within selected region 59 of tubing conduit 52. As also illustrated in FIG. 10, a tether 84 may be operatively attached to the shaped charge slitting device and/or may be utilized to position the shaped charge slitting device. Examples of the tether include a wireline and/or coiled tubing, as discussed herein.

Actuating the shaped charge slitting device at 350 may include actuating, initiating, and/or exploding a plurality of shaped charges of the shaped charge slitting device. This may include sequentially actuating at least two shaped charges in the plurality of shaped charges, at least partially concurrently actuating at least two shaped charges in the plurality of shaped charges, and/or simultaneously actuating at least two shaped charges in the plurality of shaped charges.

As indicated in FIG. 7 at 351, the actuating at 350 includes accelerating a corresponding liner of each shaped charge in the plurality of shaped charges toward the production tubing. The accelerating at 351 may be accomplished in any suitable manner. As an example, the accelerating at 351 may include initiating explosion of a corresponding explosive charge of each shaped charge in the plurality of shaped charges. Under these conditions, the accelerating at 351 may be responsive to and/or may be a result of the explosion.

The explosion may be initiated in any suitable manner. As an example, the explosion may be initiated via igniting the corresponding explosive charge. As another example, the explosion may be initiated via detonating the corresponding explosive charge. As yet another example, the explosion may be initiated with, via, and/or utilizing an initiating device, such as a primer cord, of the corresponding explosive charge. It is within the scope of the present disclosure that the initiating explosion may include initiating the explosion along and/or around an entirety of a circumferential extent of each shaped charge. Such a configuration may facilitate uniform radial slit formation during methods 300.

Figure 12:
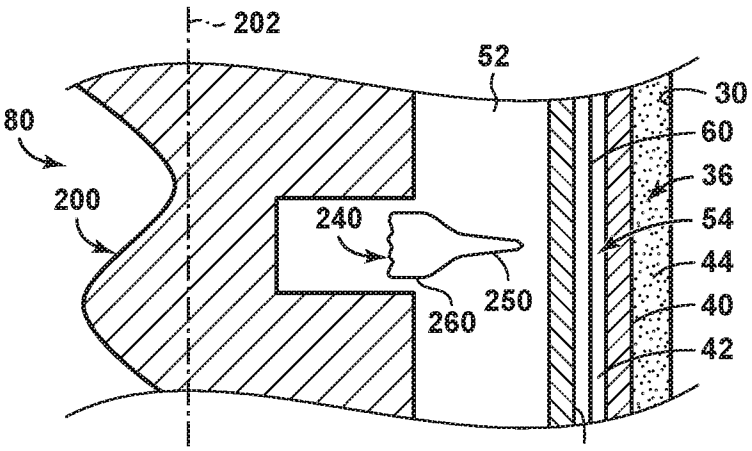
FIG. 12 is a schematic cross-sectional view of a region of a hydrocarbon well illustrating an example of a portion of the methods of FIG. 7.
Figure 11:
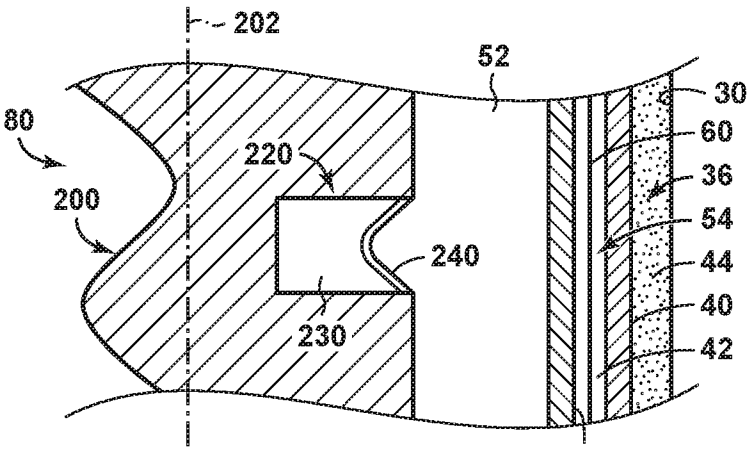
FIG. 11 is a schematic cross-sectional view of a region of a hydrocarbon well illustrating an example of a portion of the methods of FIG. 7.

An example of the accelerating at 351 is illustrated in FIGS. 11-12. As illustrated in FIG. 11, and prior to the accelerating at 351, a corresponding shaped charge 220 includes a corresponding explosive charge 230 and a corresponding liner 240. As illustrated in FIG. 12, and subsequent to the accelerating at 351, corresponding liner 240 has accelerated away from a device body of shaped charge slitting device 80 and toward production tubing 50.

As indicated in FIG. 7 at 352, the actuating at 350 includes forming a corresponding high-speed sheet portion and a corresponding low-speed slug portion from the corresponding liner. The forming at 352 may be responsive to, at least partially responsive to, and/or a result of the accelerating at 351.

The forming at 352 may include forming the corresponding high-speed sheet portion and the corresponding low-speed slug portion in any suitable manner. As an example, the forming at 352 may include liquefying and/or melting the corresponding liner to produce and/or generate the corresponding high-speed sheet portion and the corresponding low-speed slug portion.

As discussed herein, the corresponding high-speed sheet portion may travel more quickly, or have a greater speed, when compared to the corresponding low-speed slug portion. With this in mind, the forming at 352 may include spatially separating the corresponding high-speed sheet portion from the corresponding low-speed slug portion. The spatially separating, or an extent of the spatial separation, may be responsive to a speed difference between the corresponding high-speed sheet portion and the corresponding low-speed slug portion. Examples of the speed of the high-speed sheet portion and/or of the speed of the low-speed slug portion are disclosed herein. Examples of the speed difference include speed differences of at least 1 km/s, at least 2 km/s, at least 3 km/s, at least 4 km/s, at least 5 km/s, and/or at least 6 km/s. Additional examples of the speed difference include speed differences of at most 10 km/s, at most 9 km/s, at most 8 km/s, at most 7 km/s, at most 6 km/s, at most 5 km/s, and/or at most 4 km/s.

As discussed, the corresponding liner may include and/or may be formed from a plurality of materials. As an example, the corresponding liner may include a high-density fraction and a low-density fraction, and a density of the high-density fraction may be greater than a density of the low-density fraction. Under these conditions, the corresponding high-speed sheet portion may include at least a majority of the low-density fraction and the corresponding low-speed slug portion may include at least a majority of the high-density fraction. Examples of the high-density fraction include a metal and/or copper. An example of the low-density fraction includes a ceramic material.

It is within the scope of the present disclosure that the corresponding high-speed sheet portion and/or the corresponding low-speed slug portion may be defined by any suitable fraction, or proportion, of the corresponding liner. As examples, the corresponding high-speed sheet portion may be formed with and/or from at least 10 weight percent (wt %), at least 12.5 wt %, at least 15 wt %, at least 17.5 wt %, at least 20 wt %, at least 22.5 wt %, at least 25 wt %, at most 30 wt %, at most 27.5 wt %, at most 25 wt %, at most 22.5 wt %, at most 20 wt %, at most 17.5 wt %, and/or at most 15 wt % of the corresponding liner. Similarly, the corresponding low-speed slug portion may be formed with and/or from at least 70 wt %, at least 72.5 wt %, at least 75 wt %, at least 77.5 wt %, at least 80 wt %, at least 82.5 wt %, at least 85 wt %, at most 90 wt %, at most 87.5 wt %, at most 85 wt %, at most 82.5 wt %, at most 80 wt %, at most 77.5 wt %, and/or at most 75 wt % of the corresponding liner.

An example of the forming at 352 is illustrated in FIG. 12. As illustrated therein, corresponding liner 240 defines both a corresponding high-speed sheet portion 250 and a corresponding low-speed slug portion 260. As discussed, the sheet speed of the corresponding high-speed sheet portion is greater than the slug speed of the corresponding low-speed slug portion. As such, the corresponding high-speed sheet portion spatially separates, or extends, from the corresponding low-speed slug portion as the corresponding high-speed sheet portion and the corresponding low-speed slug portion travel toward production tubing 50.

As indicated in FIG. 7 at 353, the actuating at 350 includes defining a corresponding circumferential slit within the production tubing with the corresponding high-speed sheet portion of each shaped charge in the plurality of shaped charges. The defining at 353 may include defining the corresponding circumferential slit in any suitable manner. As an example, the defining at 353 may include penetrating the production tubing with the corresponding high-speed sheet portion to form and/or define the corresponding circumferential slit. As another example, the defining at 353 may include defining such that the corresponding circumferential slit extends within, or at least substantially within, a slit plane that is perpendicular to a longitudinal axis of the production tubing. Such an orientation for the circumferential slit may increase an efficiency and/or an efficacy of the severing at 354.

As discussed in more detail herein, the plurality of shaped charges may be circumferentially phased about and/or around an external surface, or a circumference, of the shaped charge slitting device. As also discussed herein, the plurality of shaped charges may be longitudinally spaced-apart along a length, or a longitudinal axis, of the shaped charge slitting device. With this in mind, the actuating at 350 may include forming and/or defining a plurality of circumferential slits within the production tubing, with each circumferential slit in the plurality of circumferential slits being formed by a corresponding shaped charge in the plurality of shaped charges. The plurality of circumferential slits may be circumferentially phased around the production tubing and may be longitudinally spaced-apart along the length of the production tubing. In addition, the plurality of circumferential slits collectively may extend around an entirety of a circumference of the production tubing. In such a configuration, the actuating at 350 may include forming the plurality of circumferential slits without severing the production tubing. In addition, such a configuration ensures that at least one corresponding high-speed sheet portion of at least one shaped charge in the plurality of shaped charges severs the control line during the severing at 354.

Figure 13:
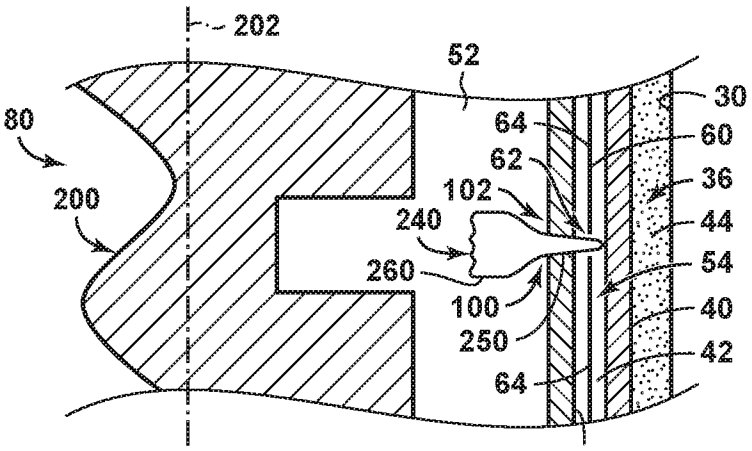
FIG. 13 is a schematic cross-sectional view of a region of a hydrocarbon well illustrating an example of a portion of the methods of FIG. 7.
Figure 15:
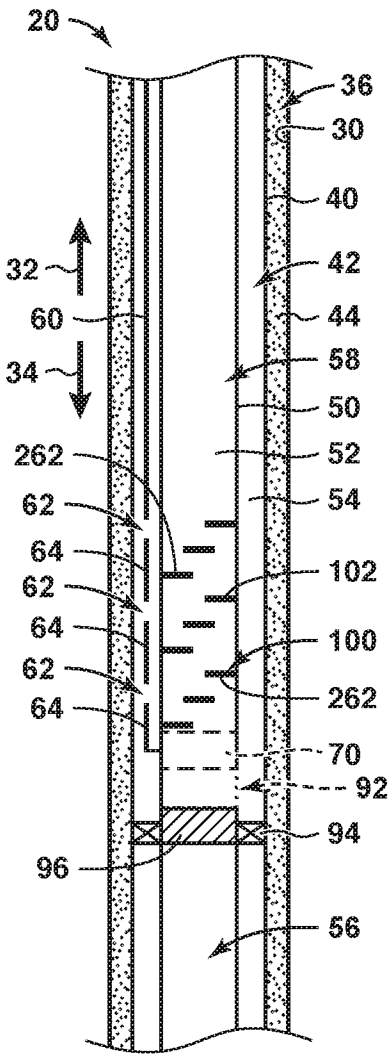
FIG. 15 is a schematic cross-sectional view of a region of a hydrocarbon well illustrating an example of a portion of the methods of FIG. 7.

An example of the defining at 353 is illustrated in FIGS. 13 and 15. As illustrated in FIG. 13, high-speed sheet portion 250 penetrates production tubing 50, thereby forming and/or defining an opening 100, in the form of a circumferential slit 102 within the production tubing. As illustrated in FIG. 15 and discussed in more detail herein, circumferential slit 102 extends around at least a portion of a circumference of production tubing 50.

As indicated in FIG. 7 at 354, the actuating at 350 includes severing the control line with the corresponding high-speed sheet portion of at least one shaped charge in the plurality of shaped charges. This may include severing the control line in at least one location and/or in a plurality of distinct locations. Stated another way, the severing at 354 may include separating the control line into at least two control line segments.

Figure 16:
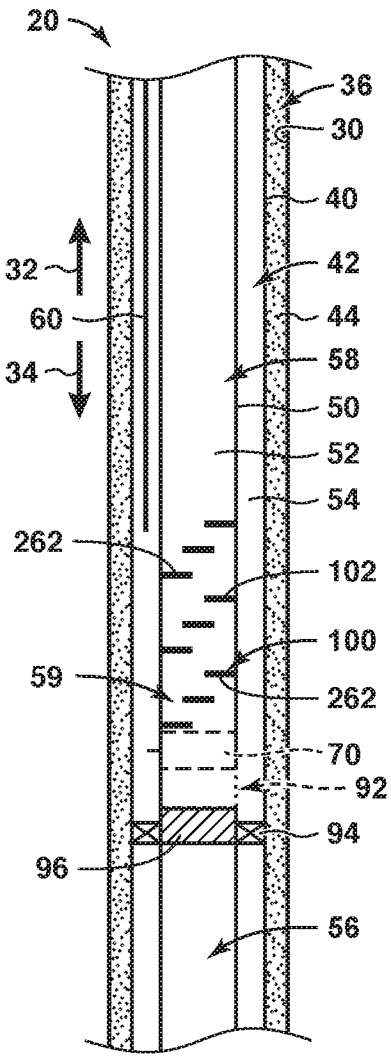
FIG. 16 is a schematic cross-sectional view of a region of a hydrocarbon well illustrating an example of a portion of the methods of FIG. 7.

Examples of the severing at 354 are illustrated in FIGS. 13 and 15-16. As illustrated in FIG. 13, and subsequent to formation of circumferential slit 102, high-speed sheet portion 250 may travel into annular space 54 and sever, or cut, control line 60. This may form and/or define a severed location 62 within the control line and/or may separate the control line into at least two control line segments 64. As illustrated in FIG. 15, and subsequent to the severing at 354, control line 60 may be severed at a plurality of severed locations 62 and may define a plurality of control line segments 64. As illustrated in FIG. 16, the control line segments may settle and/or fall, such as under the influence of gravity, within annular space 54 and/or away from selected region 59. This may permit and/or facilitate formation of a fluid seal, such as during the curing at 380 that does not include, or that is absent, control line 60 and/or control line segments 64 extending therein, therethrough, and/or entirely therethrough.

As indicated in FIG. 7 at 355, the actuating at 350 includes at least partially, or even completely, sealing the corresponding circumferential slit with the corresponding low-speed slug portion of each shaped charge. The sealing at 355 may be accomplished in any suitable manner. As examples, the sealing at 355 may include welding the corresponding circumferential slit shut with the corresponding low-speed slug portion, brazing the corresponding circumferential slit closed with the corresponding low-speed slug portion, at least partially occluding fluid flow through the corresponding circumferential slit with the corresponding low-speed slug portion, and/or resisting fluid flow through the corresponding circumferential slit with the corresponding low-speed slug portion. As another example, the sealing at 355 may include defining a metal alloy between the production tubing and the corresponding low-speed slug portion, at least within a region of the production tubing that defines the corresponding circumferential slit. As yet another example, the sealing at 355 may include at least partially filling the corresponding circumferential slit with the corresponding low-speed slug portion.

The sealing at 355 may be performed with any suitable timing and/or sequence during methods 300. As examples, the sealing at 355 may be performed subsequent to the accelerating at 351, subsequent to the forming at 352, subsequent to the defining at 353, subsequent to the severing at 354, at least partially concurrently with the defining at 353, and/or at least partially concurrently with the severing at 354.

Figure 14:
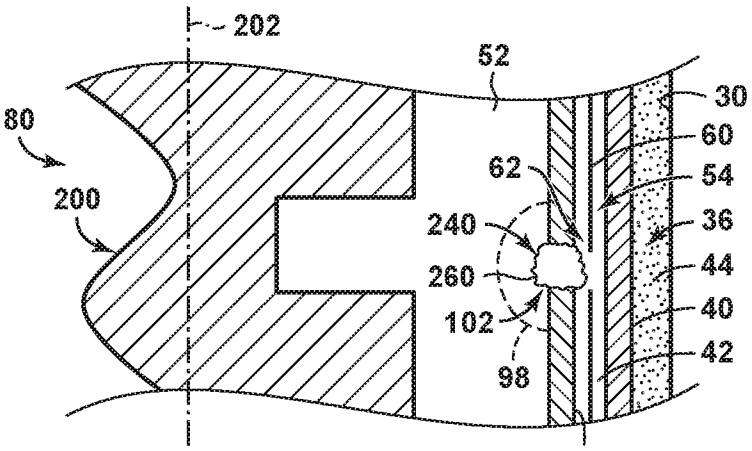
FIG. 14 is a schematic cross-sectional view of a region of a hydrocarbon well illustrating an example of a portion of the methods of FIG. 7.

An example of the sealing at 355 is illustrated in FIGS. 14-16. As illustrated in FIG. 14, and subsequent to the sealing at 355, corresponding low-speed slug portion 260 forms an at least partial fluid seal 262 that at least partially and/or fluidly seals circumferential slit 102. As illustrated in FIGS. 15-16, and subsequent to the sealing at 355, each circumferential slit 102 includes a corresponding fluid seal 262 that at least partially restricts fluid flow through the circumferential slit.

It is within the scope of the present disclosure that the sealing at 355 may include completely sealing the corresponding circumferential slit, completely restricting fluid flow though the corresponding circumferential slit, and/or sufficiently restricting fluid flow through the corresponding circumferential slit such that the pumping at 370 may be performed without a significant fraction of the sealing material flowing through the corresponding circumferential slit. However, it is also within the scope of the present disclosure, that subsequent to the sealing at 355, fluid flow through the corresponding circumferential slit may be insufficiently restricted and/or occluded. Stated another way, and subsequent to the sealing at 355, a leak between the tubing conduit and the annular space, via the corresponding circumferential slit, still may exist. Under these conditions and/or in order to mitigate a potential for sealing material flow through such a leak, methods 300 may include circulating a supplemental sealing material at 360. The circulating at 360 may include circulating the supplemental sealing material within the selected region of the tubing conduit to at least partially, or even completely, seal at least one leak between the tubing conduit and the annular space via the corresponding circumferential slit. Examples of the supplemental sealing material include a fibrous sealing material, a ground sealing material, a particulate sealing material, and/or a shredded sealing material. Additional examples of the supplemental sealing material include calcium carbonate, limestone, a polymer, rubber, drilling mud solids, and/or a suitable lost circulation material.

The circulating at 360 may be performed with any suitable timing and/or sequence during methods 300. As examples, the circulating at 360 may be performed subsequent to the sealing 355, prior to the pumping at 370, at least partially concurrently with the pumping at 370, and/or prior to the curing at 380.

An example of the circulating at 360 is illustrated in FIG. 14. As illustrated therein, and subsequent to the circulating at 360, a supplemental sealing material 98 may form an additional, or a supplemental, seal of and/or for corresponding circumferential slit 102.

Pumping the sealing material at 370 may include pumping the sealing material through the tubing conduit and into the annular space via the sealing material injection opening. This may include squeezing the sealing material from the tubing conduit and into the annular space via the sealing material injection opening and/or may include providing the sealing material to the tubing conduit from the surface region. The pumping at 370 may include pumping such that the sealing material fills at least the selected region of the tubing conduit and a corresponding region of the annular space. The corresponding region of the annular space may be partially defined by a portion of the production tubing that bounds the selected region of the tubing conduit. Stated another way, the pumping at 370 may include pumping such that, within a transverse cross-section of the wellbore that includes the selected region of the tubing conduit, both the tubing conduit and the annular space are filled, are at least substantially filled, and/or are entirely filled with the sealing material.

The pumping at 370 may be performed with any suitable timing and/or sequence during methods 300. As examples, the curing at 380 may be performed subsequent to the abandoning at 310, subsequent to the fluidly isolating at 320, subsequent to the forming at 330, subsequent to the positioning at 340, subsequent to the actuating at 350, subsequent to the circulating at 360, and/or prior to the curing at 380.

Figure 17:
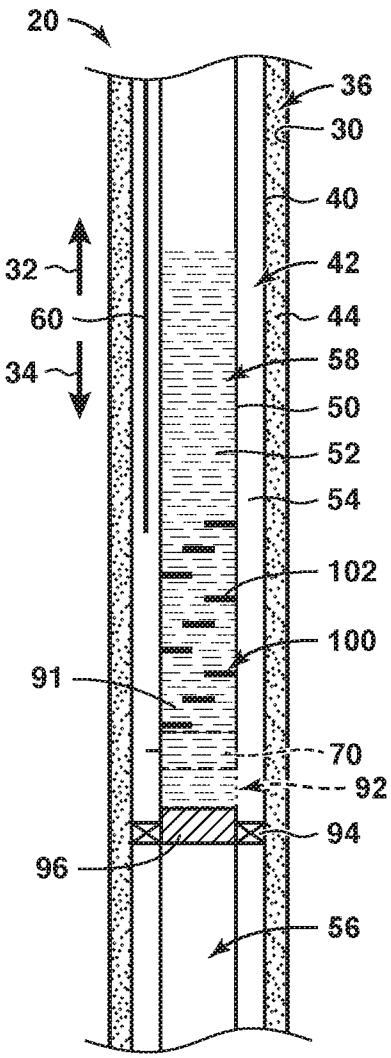
FIG. 17 is a schematic cross-sectional view of a region of a hydrocarbon well illustrating an example of a portion of the methods of FIG. 7.
Figure 18:
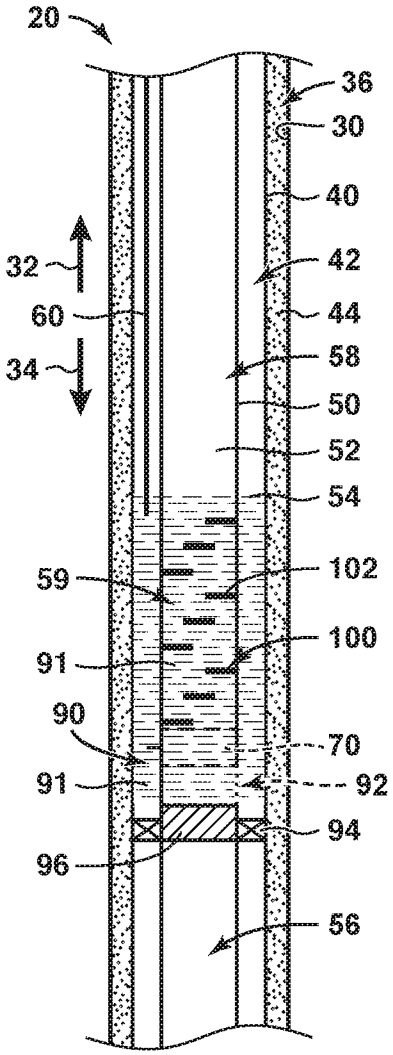
FIG. 18 is a schematic cross-sectional view of a region of a hydrocarbon well illustrating an example of a portion of the methods of FIG. 7.

An example of the pumping at 370 is illustrated in FIGS. 17-18. As illustrated in FIG. 17, a sealing material 91 flows, within tubing conduit 52 and/or in downhole direction 34, toward, to, and/or through sealing material injection opening 92. The pumping at 370 may be continued until selected region 59 of tubing conduit 5252, as well as the corresponding region of annular space 54, are filled with the sealing material.

Curing the sealing material at 380 may include curing the sealing material to form and/or define a fluid seal. The curing at 380 may include curing such that the fluid seal extends both within the corresponding region of the annular space and within the selected region of the tubing conduit. The curing at 380 may include waiting at least a threshold sealing material cure time. Examples of the threshold sealing material cure time include cure times of at least 15 minutes, at least 30 minutes, at least 45 minutes, at least 1 hour, at least 3 hours, at least 6 hours, at least 12 hours, and/or at least 24 hours. Additionally or alternatively, the threshold cure time may be a period of time sufficient to set, to harden, and/or to solidify the sealing material within the tubing conduit and within the annular space.

An example of the curing at 380 is illustrated in FIG. 18. As illustrated therein, and subsequent to the curing at 380, a fluid seal 90 extends both within selected region 59 of tubing conduit 52 and within the corresponding region of annular space 54. As also illustrated, the fluid seal may cover and/or encapsulate both sides of all circumferential slits 102 that were formed during the defining at 353, thereby fluidly isolating tubing conduit 52 from annular space 54. As also illustrated in FIG. 18 control line 60 has been severed, such as during the severing at 354, such that the control line does not extend within, does not extend through, and/or does not extend through an entirety of the fluid seal. As such, methods 300 may decrease and/or eliminate a potential for leakage of fluid seal 90 via fluid flow along and/or through the control line.

Repeating at least the portion of the methods at 390 may include repeating any suitable portion of methods 300 in any suitable order. As an example, the selected region of the tubing conduit may include and/or be a first selected region of the tubing conduit, the fluid seal may include and/or be a first fluid seal, and the corresponding region of the annular space may include and/or be a first corresponding region of the annular space. Under these conditions, the repeating at 390 may include repeating the positioning at 340 to position the shaped charge slitting device within a second selected region of the tubing conduit. The repeating at 390 then may include repeating at least the actuating at 350, the pumping at 370, and the curing at 380 to form a second fluid seal that extends both within the second selected region of the tubing conduit and also within a second corresponding region of the annular space. Under these conditions, the second region of the tubing conduit may be uphole, or positioned in the uphole direction, from and/or relative to the first selected region of the tubing conduit.

In the present disclosure, several of the illustrative, non-exclusive examples have been discussed and/or presented in the context of flow diagrams, or flow charts, in which the methods are shown and described as a series of blocks, or steps. Unless specifically set forth in the accompanying description, it is within the scope of the present disclosure that the order of the blocks may vary from the illustrated order in the flow diagram, including with two or more of the blocks (or steps) occurring in a different order and/or concurrently.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entities in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B, and C," "at least one of A, B, or C," "one or more of A, B, and C," "one or more of A, B, or C," and "A, B, and/or C" may mean A alone, B alone, C alone, A and B together, A and C together, B and C together, A, B, and C together, and optionally any of the above in combination with at least one other entity.

In the event that any patents, patent applications, or other references are incorporated by reference herein and (1) define a term in a manner that is inconsistent with and/or (2) are otherwise inconsistent with, either the non-incorporated portion of the present disclosure or any of the other incorporated references, the non-incorporated portion of the present disclosure shall control, and the term or incorporated disclosure therein shall only control with respect to the reference in which the term is defined and/or the incorporated disclosure was present originally.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

As used herein, the phrase, "for example," the phrase, "as an example," and/or simply the term "example," when used with reference to one or more components, features, details, structures, embodiments, and/or methods according to the present disclosure, are intended to convey that the described component, feature, detail, structure, embodiment, and/or method is an illustrative, non-exclusive example of components, features, details, structures, embodiments, and/or methods according to the present disclosure. Thus, the described component, feature, detail, structure, embodiment, and/or method is not intended to be limiting, required, or exclusive/exhaustive; and other components, features, details, structures, embodiments, and/or methods, including structurally and/or functionally similar and/or equivalent components, features, details, structures, embodiments, and/or methods, are also within the scope of the present disclosure.

INDUSTRIAL APPLICABILITY

The systems and methods disclosed herein are applicable to the oil and gas industries.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions, and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements, and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

What is claimed is:

1. A method of sealing a hydrocarbon well, the method comprising:

positioning a shaped charge slitting device within a selected region of a tubing conduit, wherein the hydrocarbon well includes a wellbore extending within a subsurface region, a casing string extending within the wellbore and defining a casing conduit, production tubing extending within the casing conduit and defining the tubing conduit, and a control line extending within an annular space defined between the casing string and the production tubing;

actuating the shaped charge slitting device, wherein the shaped charge slitting device includes a plurality of shaped charges, and further wherein the actuating includes:

(i) accelerating a corresponding liner of each shaped charge in the plurality of shaped charges toward the production tubing;

(ii) responsive to the accelerating, forming a corresponding high-speed sheet portion and a corresponding low-speed slug portion from the corresponding liner;

(iii) defining a corresponding circumferential slit within the production tubing with the corresponding high-speed sheet portion of each shaped charge;

(iv) severing the control line with the corresponding high-speed sheet portion of at least one shaped charge in the plurality of shaped charges; and (v) at least partially sealing the corresponding circumferential slit with the corresponding low-speed slug portion of each shaped charge;

pumping a sealing material, via the tubing conduit, into the annular space via a sealing material injection opening that extends between the tubing conduit and the annular space such that the sealing material fills at least the selected region of the tubing conduit and a corresponding region of the annular space that is partially defined by a portion of the production tubing that bounds the selected region of the tubing conduit; and curing the sealing material to form a fluid seal that extends both within the corresponding region of the annular space and within the selected region of the tubing conduit.

2. The method of claim 1, wherein the method further includes fluidly isolating the selection region of the tubing conduit from a region of the tubing conduit that is downhole from the selected region of the tubing conduit.

3. The method of claim 1, wherein the method further includes forming the sealing material injection opening.

4. The method of claim 1, wherein the selected region of the tubing conduit is a first selected region of the tubing conduit, wherein the fluid seal is a first fluid seal, wherein the corresponding region of the annular space is a first corresponding region of the annular space, and further wherein the method includes:

(i) repeating the positioning the shaped charge slitting device to position the shaped charge slitting device within a second selected region of the tubing conduit; and (ii) repeating the actuating, the pumping, and the curing within the second selected region of the tubing conduit to form a second fluid seal that extends both within the second selected region of the tubing conduit and within a second corresponding region of the annular space.

5. The method of claim 1, wherein the actuating includes initiating explosion of a corresponding explosive charge of each shaped charge in the plurality of shaped charges, wherein the accelerating is responsive to the initiating explosion.

6. The method of claim 5, wherein the initiating explosion includes at least one of:

(i) igniting the corresponding explosive charge; and (ii) detonating the corresponding explosive charge.

7. The method of claim 1, wherein the corresponding high-speed sheet portion has a tip speed of at least 6 kilometers per second and at most 9 kilometers per second.

8. The method of claim 1, wherein the corresponding high-speed sheet portion has a base speed of at least 1 kilometer per second and at most 3 kilometers per second.

9. The method of claim 1, wherein the corresponding low-speed slug portion has a slug speed of less than 1 kilometer per second.

10. The method of claim 1, wherein the corresponding liner includes a high-density fraction and a low-density fraction, wherein a density of the high-density fraction is greater than a density of the low-density fraction, wherein the corresponding high-speed sheet portion includes at least a majority of the low-density fraction, and further wherein the corresponding low-speed slug portion includes at least a majority of the high-density fraction.

11. The method of claim 10, wherein the high-density fraction includes at least one of a metal and copper.

12. The method of claim 10, wherein the low-density fraction includes a ceramic material.

13. The method of claim 1, wherein the forming includes forming the corresponding high-speed sheet portion with at least 10 weight percent and at most 30 weight percent of the corresponding liner.

14. The method of claim 1, wherein the forming includes forming the corresponding low-speed slug portion with at least 70 weight percent and at most 90 weight percent of the corresponding liner.

15. The method of claim 1, wherein the corresponding circumferential slit of each shaped charge at least partially circumferentially overlaps with the corresponding circumferential slit of at least one other shaped charge.

16. The method of claim 1, wherein the actuating includes forming a plurality of circumferential slits within the production tubing, and further wherein:

(i) the plurality of circumferential slits is circumferentially phased around the production tubing;

(ii) the plurality of circumferential slits is longitudinally spaced-apart along a length of the production tubing; and (iii) the plurality of circumferential slits extends around an entirety of a circumference of the production tubing.

17. The method of claim 1, wherein the actuating includes actuating without severing the production tubing.

18. The method of claim 1, wherein the pumping the sealing material includes squeezing the sealing material from the tubing conduit and into the annular space via the sealing material injection opening.

19. A shaped charge slitting device configured to form a plurality of circumferential slits within production tubing and also to seal the plurality of circumferential slits, wherein the production tubing extends within a wellbore that extends within a subterranean formation, wherein a control line extends within an annular space defined between the wellbore and the production tubing, and further wherein the shaped charge slitting device is configured to sever the control line, the shaped charge slitting device comprising:

a device body that defines a body longitudinal axis; and a plurality of shaped charges spaced-apart along the body longitudinal axis, wherein:

(i) each shaped charge in the plurality of shaped charges includes a corresponding explosive charge and a corresponding liner;

(ii) each shaped charge extends circumferentially around at least 10% and at most 90% of a circumference of the device body;

(iii) each shaped charge at least partially circumferentially overlaps with at least two other shaped charges in the plurality of shaped charges;

(iv) the plurality of shaped charges is angularly phased around the circumference of the device body such that the plurality of shaped charges collectively extends around an entirety of the circumference; and (vi) each shaped charge is configured to, upon actuation, transform the corresponding liner into a corresponding high-speed sheet portion and a corresponding low-speed slug portion, wherein the corresponding high-speed sheet portion is configured to form a corresponding circumferential slit within the production tubing and to sever the control line, and further wherein the corresponding low-speed slug portion is configured to at least partially seal the corresponding circumferential slit.

20. A hydrocarbon well, comprising:

a wellbore extending within a subsurface region;

a casing string extending within the wellbore and defining a casing conduit;

production tubing extending within the casing conduit and defining a tubing conduit;

a control line extending within an annular space defined between the casing string and the production tubing; and the shaped charge slitting device of claim 19 positioned within a wellbore.

* * * * *